US008256509B2

(12) United States Patent
Evans

(10) Patent No.: US 8,256,509 B2
(45) Date of Patent: Sep. 4, 2012

(54) COMPACT JAR FOR DISLODGING TOOLS IN AN OIL OR GAS WELL

(75) Inventor: Robert W. Evans, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 134 days.

(21) Appl. No.: 12/575,811

(22) Filed: Oct. 8, 2009

(65) Prior Publication Data

US 2011/0083851 A1 Apr. 14, 2011

(51) Int. Cl.
*E21B 31/107* (2006.01)
*E21B 17/07* (2006.01)

(52) U.S. Cl. ..... 166/178; 166/301

(58) Field of Classification Search ..... 166/178, 166/301
See application file for complete search history.

(56) References Cited

U.S. PATENT DOCUMENTS 4,646,830 A * 3/1987 Templeton ..... 166/178
6,290,004 B1 9/2001 Evans
6,988,551 B2 1/2006 Evans
7,290,604 B2 11/2007 Evans
7,311,149 B2 12/2007 Evans
7,510,008 B2 * 3/2009 Evans ..... 166/301
2005/0092484 A1 5/2005 Evans
2005/0092495 A1 5/2005 Evans
2006/0169456 A1 8/2006 Evans
2009/0020287 A1 1/2009 Evans

OTHER PUBLICATIONS

PCT/US2010/051904 International Search Report and Written Opinion, May 9, 2011 (8 p.).

* cited by examiner

*Primary Examiner* — Daniel P Stephenson
*Assistant Examiner* — Catherine Loikith
(74) *Attorney, Agent, or Firm* — Conley Rose, P.C.

(57) ABSTRACT

This invention relates to a jar used to dislodge tools stuck in a well. The jar includes two housing portions movable with respect to each other. A release collet forms a portion of one of the housings. A release sleeve is carried by a mandrel and is located within the release collet. After a given amount of movement of the housing with respect to the mandrel, the release mechanism is activated and the two housing sections rapidly move with respect to each other. A hammer portion of the mandrel then strikes an anvil in the anvil housing, thus applying an upward force to the tool lodged in the well.

7 Claims, 2 Drawing Sheets

COMPACT JAR FOR DISLODGING TOOLS IN AN OIL OR GAS WELL

BACKGROUND OF INVENTION

1. Field of the Invention

This invention is directed to a tool for exerting an upward force on another tool that may have become stuck in an oil or gas well. Such tools are commonly referred to as "jars." Typically jars include a connecting device that is released at a certain level of force being applied to the line to cause a hammer to strike an anvil surface within the tool. The present invention is directed to an improvement in such a device 2. Description of Related Art The sticking of drilling or production equipment in an oil or gas well bore may be eliminated by delivering an upward axial blow to unstick the equipment. Downhole tools known as "jars" have been used in such situations. One type of jar is a "drilling jar." Another type of jar is a "wireline jar." In the case of a wireline jar, a series of impact blows is delivered to the stuck equipment by manipulation of the wireline. Wireline jars typically have an inner mandrel and an outer housing telescopically coupled together for relative axial, sliding movement. The mandrel carries a hammer and the housing carries an anvil. By directing the hammer to impact the anvil at high velocity, a substantial jarring force may be imparted to the stuck equipment, which is often sufficient to jar the stuck equipment free.

Examples of prior art jars are described in U.S. Pat. Nos. 6,988,551; 7,290,604; and 7,311,149.

BRIEF SUMMARY OF THE INVENTION

The present invention is directed to an improved release mechanism in a jar. The mechanism is extremely reliable and effective in delivering an upward jarring force on the stuck tool below it. This is achieved by forming a portion of the release collet as part of the housing and having the release sleeve carried by a mandrel that slides within the release collet. The resulting structure is compact and efficient.

BRIEF DESCRIPTION OF THE SEVERAL VIEWS OF THE DRAWING(S)

DETAILED DESCRIPTION OF THE INVENTION

Figure 1A:
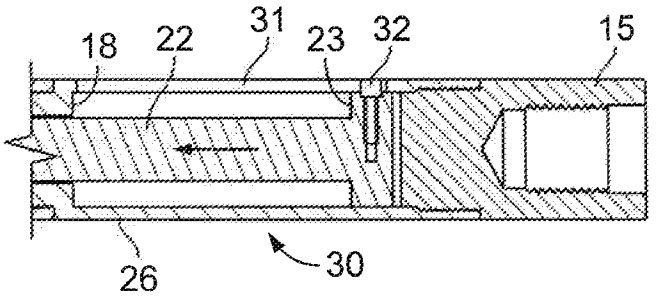
FIGS. 1A and 1B are sectional longitudinal views of the jar with no load applied.
Figure 1B:
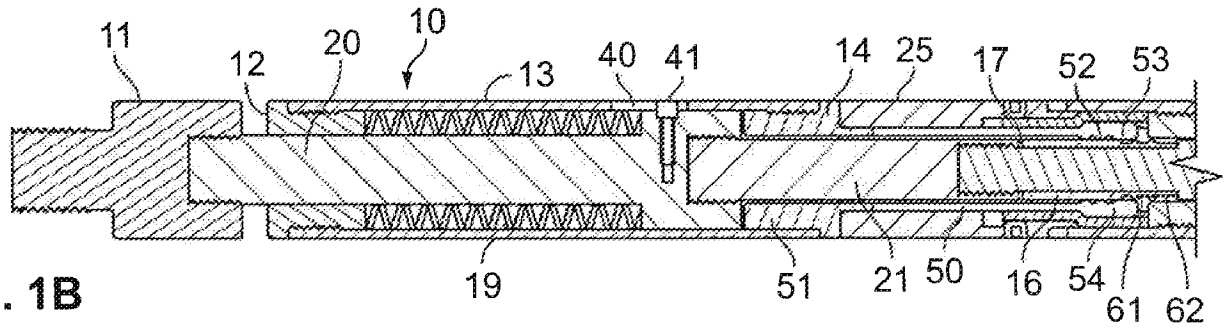
Figure 2B:
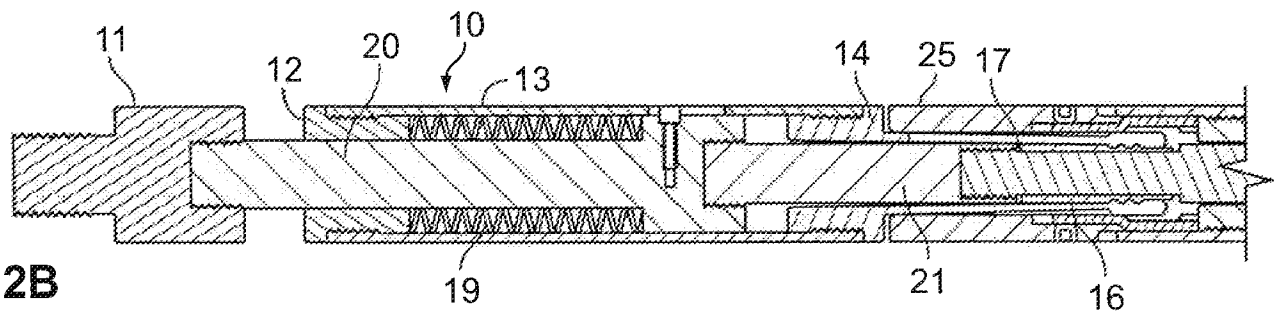

The invention will now be described in conjunction with reference to the drawings. The term proximal when used refers to that portion of the part being referred to that is closest to the wellhead, and the term distal refers to the portion of the part that is furthest from the wellhead. As shown in FIG. 1B, the jar includes a mandrel connection pin 11 for attachment to the wireline. Connected within an internal bore in the mandrel connection pin 11 is the main mandrel portion 20 having an enlarged portion at the distal end thereof for receiving an externally threaded portion of collet mandrel 21. Collet mandrel 21 has a distal internally threaded bore to which is threaded hammer mandrel 22. As described, the mandrel of the jar includes main mandrel portion 20, collet mandrel 21 and hammer mandrel 22. Hammer mandrel 22 has an enlarged hammer surface 23 as shown FIG. 1A. A cylindrical housing member 10 surrounds the mandrel assembly and includes spring housing 13 with slot 40, proximal seal housing 12 and release collet 14. A pin 41 is located within slot 40 and is threadedly secured to main mandrel portion 20 as shown in FIG. 1B. Seal housing 12 is threadedly secured to the proximal portion of spring housing 13 and release collet 14 is threadedly secured to spring housing 13 at its distal portion as shown in FIG. 1B.

Figure 2A:
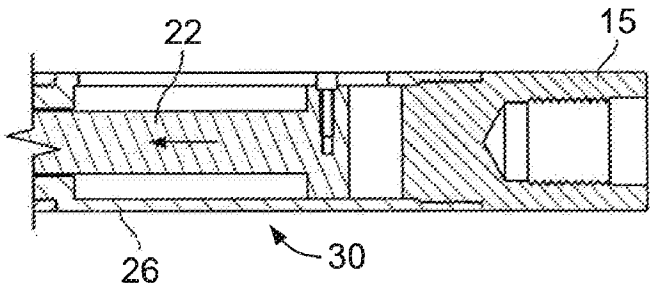
FIGS. 2A and 2B are longitudinal views of the jar as the jar is activated.
Figure 3A:
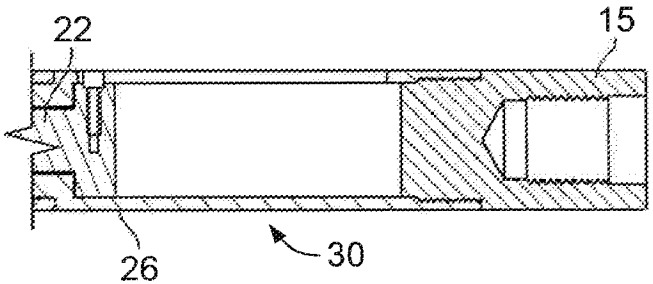
FIGS. 3A and 3B are sectional views of the device after the device has been actuated.
Figure 3B:
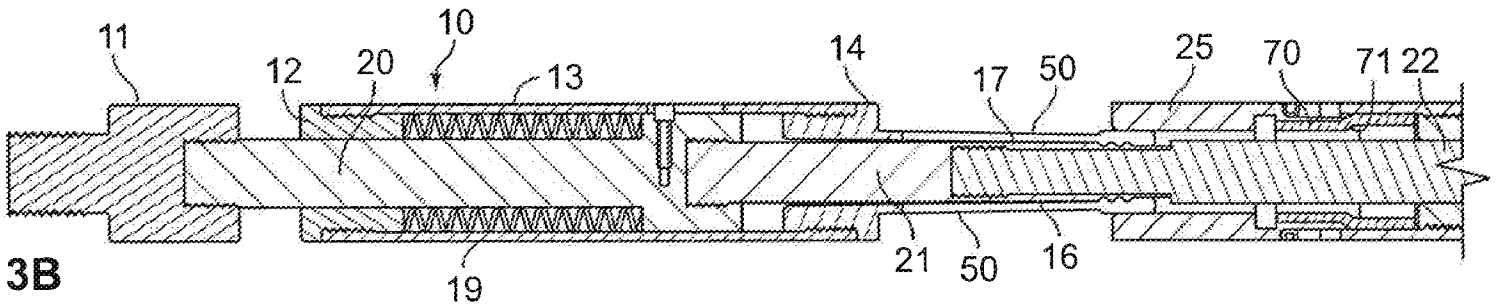

A second cylindrical housing member 30 surrounds the distal portion of the mandrel and is longitudinally movable with respect to the mandrel as shown in FIG. 3 A. The second housing has a collet housing 25 (FIG. 3B), which has an internally thread bore section at its distal end that receives hammer housing 26. Located within the hammer housing is an anvil shoulder 18 at the proximal portion of the hammer housing. Hammer housing 26 is internally threaded at its distal end to receive a tool connection housing 15, which is adapted to be threadedly connected to a downhole tool, not shown. The hammer housing also includes a longitudinal slot 31 thru which a pin 32 is received. The pin is fixed to an enlarged portion of the hammer mandrel at its distal end as shown in FIG. 2A.

A spring device 19, which may be a series of bellville washers, is located between the spring housing 13 and main mandrel portion 20. At its proximal end spring 19 abuts against a shoulder formed on the distal end of seal housing 12 and at its distal end abuts a shoulder formed on main mandrel 20. Release collet 14 has a plurality of flexible finger members 50 extending from a main body section 51 as shown in FIG. 1B. Each finger has a plurality of tabs 52 extending radially inwardly of the same width and an end tab 53 of greater thickness than tabs 52 as seen in FIG. 1B. A collet release sleeve 16 is mounted on the proximal end of hammer mandrel 22. A spring washer 17 is positioned on the proximal end of hammer mandrel between the proximal portion of the collet release sleeve 16 and the distal end face of collet mandrel 21. The collet release sleeve 16 has a plurality of grooves 61 that are adapted to receive the tabs 52 of the finger members when the mandrel moves a given distance within the release collet 14. Release sleeve 16 also has an enlarged groove 62 on its distal end to receive end tab 53 on each of the flexible fingers 50 of the release collet. Fingers 50 also have a slightly angled abutment surface 54 located on their outer surface at the enlarged portion of the fingers 50 as shown in FIG. 1B.

The side walls of the tabs 52, 53 and the side walls of the grooves 61, 62 are slightly inclined as shown in FIG. 1B to allow for sliding movement with respect to each other.

Located between the release collet fingers and the collet housing 25 is an annular wear sleeve 70.

In operation, a tensile force applied to the mandrel connection will cause the mandrel to extend (right to left looking at FIG. 1), which in turn will cause spring 19 to compress. Release sleeve 16 moves with the collet mandrel 21 and eventually moves to a position where the tabs on the flexible fingers of the release collet 14 register with the grooves on the release sleeve 16 so that the fingers flex inwardly due to the forces at abutment surfaces 54 and abutment surface 71. The abutment shoulders 54 on the fingers are no longer engaged with the abutment surface 71 on the wear sleeve 70. At this point release collet 14 engages the mandrel via release sleeve 16. The tensile force on the wire pulls the mandrel up. The second housing and the tool attached to it are rapidly released from the first housing and hammer mandrel surface 23 is pulled up by the tension on the wireline until it strikes anvil 18, thereby exerting an upward force on the tool lodged in the well.

Although the present invention has been described with respect to specific details, it is not intended that such details should be regarded as limitations on the scope of the invention, except to the extent that they are included in the accompanying claims.

I claim:

1. A jar comprising:

a mandrel, first and second housing members positioned about the mandrel, and a release collet forming an end portion of the first housing member;

a release sleeve radially disposed between the mandrel and the release collet and being selectively axially movable relative to the release collet, the release sleeve having an outer diameter portion at which the release collet contracts radially inwardly to engage the release sleeve;

a first biasing member positioned in the first housing member to resist axial movement of the mandrel;

wherein the release collet includes a plurality of flexible fingers, each finger having at least one inwardly extending tab, and the release sleeve has at least one groove adapted to receive the tabs on the fingers when the release collet and release sleeve move longitudinally with respect to each other;

wherein at least one tab on the fingers has a width greater than that of the other tabs on the fingers and at least one groove on the release sleeve is wider than the width of the other grooves on the release sleeve;

wherein each of the flexible fingers has an abutment surface on its exterior, distal end, and a wear sleeve within the second housing having an annular abutment shoulder configured to engage the abutment surfaces on the fingers of the release collet prior to release.

2. A jar according to claim 1 wherein the second housing member includes an anvil housing section that has an anvil at its proximal end.

3. A jar according to claim 2 wherein the mandrel has a hammer portion that includes a hammer surface located at its distal end configured to strike the anvil in the anvil housing section after the release collet engages the release sleeve.

4. A jar according to claim 3 wherein the second housing member includes a housing connector for connecting the jar to a downhole tool.

5. The jar according to claim 1 wherein the first housing is configured to move axially relative to the second housing upon engagement of the at least one grove of the release sleeve and the tabs on the fingers of the release collet.

6. A jar comprising: a first housing member including a spring housing, a seal housing and release collet, a second housing member including a collet housing, a hammer housing and a housing box connector, the first and second housing members being longitudinally movable with respect to each other, a mandrel telescopically received within the first and second housings and including a main mandrel portion, a collet mandrel portion, and a hammer mandrel portion, a spring member located between the spring housing and the main mandrel portion, the one end of the spring member abutting a shoulder formed on the internal portion of the seal housing and the other end of the spring member engaging an enlarged surface of the main mandrel portion, the release collet including a plurality of flexible fingers extending longitudinally from the collet body and each finger having a plurality of tabs extending radially inwardly and each finger having an abutment surface on the outer portion of the finger, an abutment surface located within the collet housing normally in contact with the abutment surfaces of the fingers, a release sleeve mounted on the mandrel and positioned within the release collet, the release sleeve being axially moveable with the mandrel, the release sleeve having a plurality of grooves that receive the tabs on the fingers of the release collet after the release collet and the release sleeve have moved a given distance with respect to each other, a hammer surface at the distal end of the hammer mandrel, an anvil located within the second housing member, whereby when the mandrel is moved axially by the force on the wireline, the tabs on the flexible fingers of the release collet come into alignment with the grooves on the release sleeve, thus releasing the first housing from the second housing and causing the hammer surface on the mandrel to strike the anvil located within the second housing member.

7. A jar according to claim 6 wherein a wear sleeve is positioned between the collet housing and the release collet, the wear sleeve having an annular abutment surface that contacts the abutment surfaces of the flexible fingers.

* * * * *